US006149454A

United States Patent [19]

Watanabe

[11] Patent Number: 6,149,454

[45] Date of Patent: Nov. 21, 2000

[54] PRESSURE-CONNECTION CONNECTOR WITH ESCAPE CHANNELS

[75] Inventor: Toru Watanabe, Tokyo, Japan

[73] Assignee: Hirose Electric Co., Ltd., Tokyo, Japan

[21] Appl. No.: 09/280,539

[22] Filed: Mar. 30, 1999

[30] Foreign Application Priority Data

Mar. 31, 1998 [JP] Japan ..... 10-101757

[51] Int. Cl.[7] ..... H01R 4/24; H01R 4/26; H01R 11/20

[52] U.S. Cl. ..... 439/418

[58] Field of Search ..... 439/418, 391, 439/389, 387, 676

[56] References Cited

U.S. PATENT DOCUMENTS 4,650,269 3/1987 Denkmann et al. ..... 439/426
4,909,755 3/1990 Chen ..... 439/418
4,950,176 8/1990 Cocco et al. ..... 439/344
5,246,381 9/1993 Tashio et al. ..... 439/395
5,284,447 2/1994 Kristiansen ..... 439/425
5,830,005 11/1998 Watanabe ..... 439/418
5,888,100 3/1999 Bofill et al. ..... 439/676

*Primary Examiner*—Neil Abrams
*Assistant Examiner*—Michael C. Zarroli
*Attorney, Agent, or Firm*—Kanesaka & Takeuchi

[57] ABSTRACT

A pressure-connection connector (1) comprises a terminal (3) having a pair of pressure-connection blade members (12) displaced in opposite directions in a direction of terminal thickness and guided by escape channels (6A) extending vertically in opposite face of a pressure-insertion slot (6). The terminal further comprises at least one pair of permanent latch members (13) and temporary latch members (14) for engagement with side walls of the pressure-insertion slot. The permanent latch members interfere with the pressue-insertion slot greater that the temporary latch.

5 Claims, 5 Drawing Sheets

PRESSURE-CONNECTION CONNECTOR WITH ESCAPE CHANNELS

BACKGROUND OF THE INVENTION

1. Field of the Invention

The present invention relates to pressure-connection terminals for electrical connectors.

2. Description of the Related Art

FIG. 4 shows a modular connector of this type. A terminal slot 52 is provided at an upper right-hand corner of a housing 51. A terminal 53 made of a metal sheet is provided in the terminal slot 52.

As FIGS. 5(A) and 5(B) show, the terminal 53 has a T-shaped, flat terminal base 54 with a head portion 54A and a pressure-connection section 55 extending downwardly from the terminal base 54. A pair of stop shoulders 54B are provided on the lower edges of the head portion 54A. A terminal recess 56 is provided in the pressure-connection section 55 to form a pair of blade members. The pressure-connection section 55 is gradually thinned to the front end in the form of a blade. See FIG. 5(B). A pair of temporary latch members 57 with a rounded projection are provided on the side edges opposite to the terminal recess 56. A pair of permanent latch members 58 are provided on side edges of the terminal base 54. The distance between the tips of permanent latch members 58 is made slightly greater than the distance between the tips of temporary latch members 57 so that the permanent latch members 58 extend outwardly more than the temporary latch members 57.

As FIG. 5(B) shows, the pressure-connection blade members 55 are displaced in opposite directions such that the distance of the displacement (d) is smaller than the diameter of a cable (C).

In FIG. 4, the housing 51 is made from an insulating material so as to provide a plurality of terminal slots 52 which are arranged in parallel to the sheet. Each terminal slot 52 has a press-insertion section 52A for receiving the portion below the stop shoulders 54B and a pair of abutment surfaces 59 for supporting the stop shoulders 54B. The width of the pressure-insertion section 52A is slightly smaller than the distance between the tips of the temporary latch members 57.

A plurality of cable insertion holes 60 are provided in the housing 51 for receiving the cables (C) and communicate with the pressure-insertion slots 52A.

A plastic member 61 is provided in a rear recess 60A of the housing 51 in a direction perpendicular to the cables (C) in the cable insertion holes 60 to form a pair of thin wall portions 62 on opposite sides. A resilient lock arm 63 extends rearwardly from the front portion of the housing 51.

In this conventional connector, the terminal 53 is pushed into the terminal slot 52 until the temporary latch member 57 cuts into the side wall of the pressure-insertion section 52A so that the terminal 53 is held by the housing 51. In this point, the pressure-connection section 55 does not enter the cable insertion hole 60.

The cable (C) is then inserted into the cable insertion hole 60, and the terminal 53 is further depressed. The stop edges 54B of the terminal 53 abut against the stop shoulders 59 of the housing to thereby prevent further insertion of the terminal 53, when the pressure-connection blade members 55 pierce into the cable (C). The pressure-connection blade members 55 penetrate into the core wire (C1) while bending it between them. Also, see FIG. 5(B).

Then, the plastic member 61 is depressed and plastically deformed with a tool so as to crash and hold the cable (C) in place.

However, the following improvements are demanded for the conventional terminal of FIGS. 4 and 5.

While the temporary latch members 57 are pushed into the pressure-insertion slot 52A, they cut the side walls of the pressure-insertion slot 52A. When the permanent latch members 57, which are located in different planes from the temporary latch members 57, are pressed-in, they cut the walls at locations slightly different from the cut locations of the temporary latch members 57. Consequently, the force necessary for the pressure-insertion of the permanent latch members becomes large. This large impact causes damage to the walls of the pressure-insertion section 52A where the permanent latch members 58 engage the pressure-insertion section 52A, resulting in the reduced holding power of the terminal.

In addition, since the terminal recess 56 is relatively shallow, a thick cable cannot be bent satisfactorily between the pressure-connection blade members 55.

SUMMARY OF THE INVENTION

Accordingly, it is an object of the invention to provide a pressure-connection terminal which has a large holding power and is able to retain a somewhat thick cable.

According to the invention there is provided a pressure-connection terminal for a housing having a pressure-insertion slot, which comprises a terminal base provided in parallel to a plane including an axial direction of a cable; and a pair of pressure-connection blade members extending downwardly from the terminal base to form a terminal recess between them and displaced in opposite directions in a direction of terminal thickness.

Also, it comprises at least one pair of permanent latch members provided on opposite side walls of the terminal base for engagement with side walls of the pressure-insertion slot; and at least one pair of temporary latch members provided on the opposite side walls below the permanent latch members for engagement with the side walls of the pressure-insertion slot.

Both the permanent and temporary latch members are provided on the same side edges of the terminal base to thereby achieve the above object.

Since the permanent and temporary latch members lie in the same plane, the permanent latch members further cut the traces made by the temporary latch members as the terminal is pushed into the pressure-insertion slot. Consequently, the amount of cut made by the permanent latch members is so small that no large force is required to push the terminal into the pressure-insertion slot. As a result, no damage is made to the side walls of the pressure-insertion slot, keeping the holding power of the terminal.

The diameter of a cable to be connected to the terminal can vary, and it is preferred that the terminal recess extends to the terminal base so that the pressure-connection blade members are more flexible in the direction of the terminal thickness to receive a thicker cable. For this purpose, it is preferred that the terminal recess extends to a point between the permanent and temporary latch members.

Further, it is preferred that the blade members each have a pointed end, a distance between the pointed ends is less than an extension of the terminal recess.

DESCRIPTION OF THE PREFERRED EMBODIMENT

Figure 1:
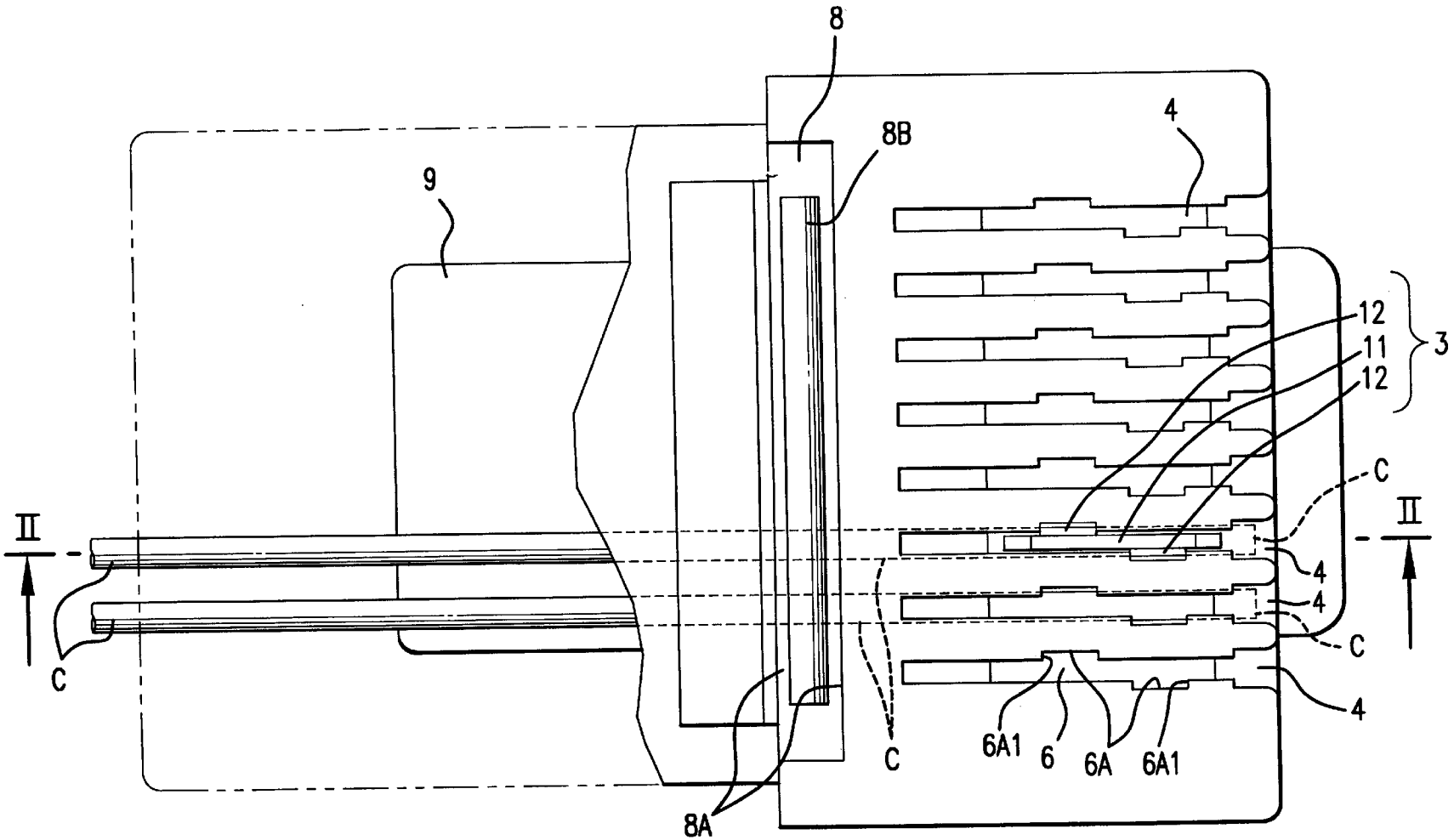
FIG. 1 is a plan view of a modular connector employing a terminal according to an embodiment of the invention.

Embodiments of the invention will now be described with respect to FIGS. 1–3 of the accompanying drawings.

A connector 1 comprises a housing 2 made from an insulating material and a plurality of terminals 3.

The housing has a substantially parallelepiped form and a plurality of terminal slots 4 at the upper front corner. In FIG. 1, a cable (C) is placed in the second terminal slot 4 from bottom, and a terminal 3 is pressure-connected to another cable (C) in the third terminal slot 4 from bottom.

Figure 2:
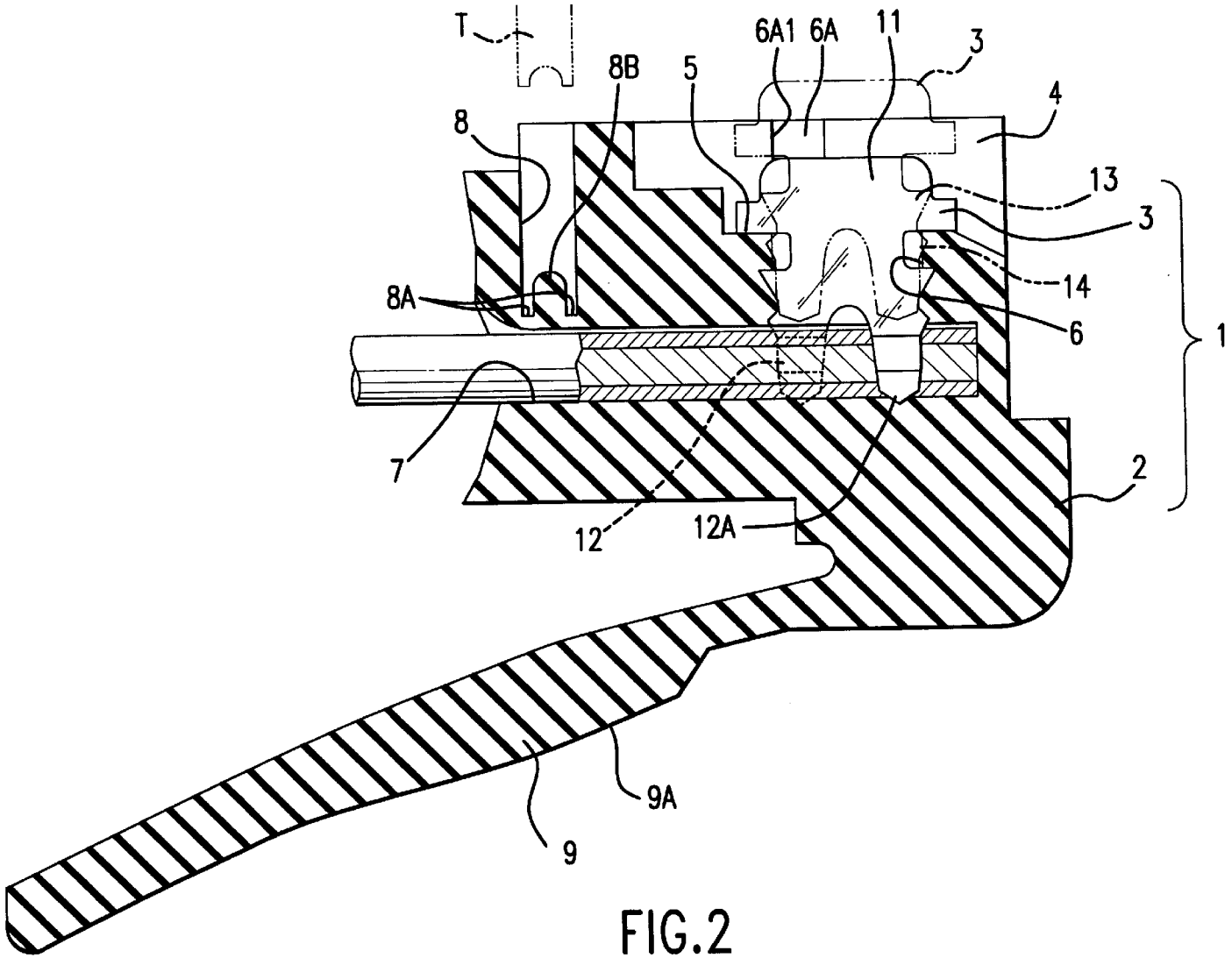
FIG. 2 is a sectional view taken along line II—II of FIG. 1.
Figure 3B:
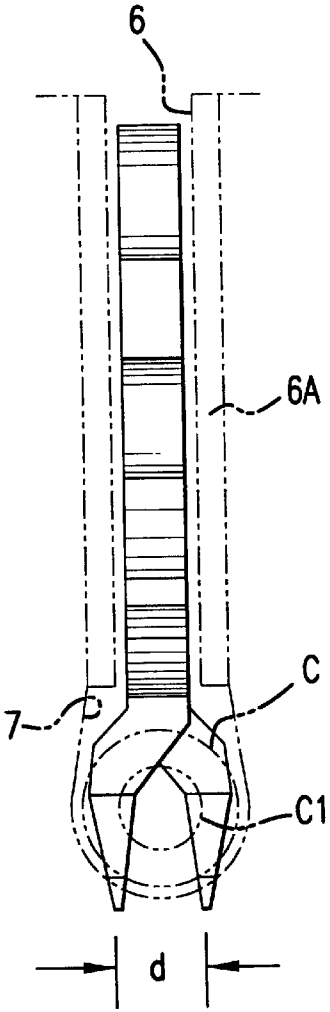
FIGS. 3(A) and (B) are front and sectional views of the terminal used in the connector.

In FIG. 2, the terminal slot 4 extends in a plane parallel to the sheet and opens at the upper face of the housing. It has a pair of stop shoulders 5 and a pressure-insertion section 6 extending downwardly from the stop shoulders 5. A pair of escape channels 6A extend vertically in opposite faces of the pressure-insertion section 6.

A plurality of cable insertion holes 7 extend toward and stop near the front end of the housing 1. Each cable insertion hole 7 communicates with the corresponding pressure-insertion slot 6. Also, see FIG. 3(B). A rear recess 8 extend downwardly up to a position close to the cable insertion holes 7.

A pair of thin-wall portions 8A, which reduce the wall thickness between the cable insertion holes 7 and the rear recess 8, are provided on the bottom of the rear recess 8 to form a plastic ridge 8B.

A resilient lock arm 9 extends diagonally rearwardly from the lower front portion of the housing 1 and has a lock surface 9A in the middle position to engage a mating connector. By flexing the lock arm 9 upwardly, the lock is released to permit its removal from the mating connector.

Figure 3A:
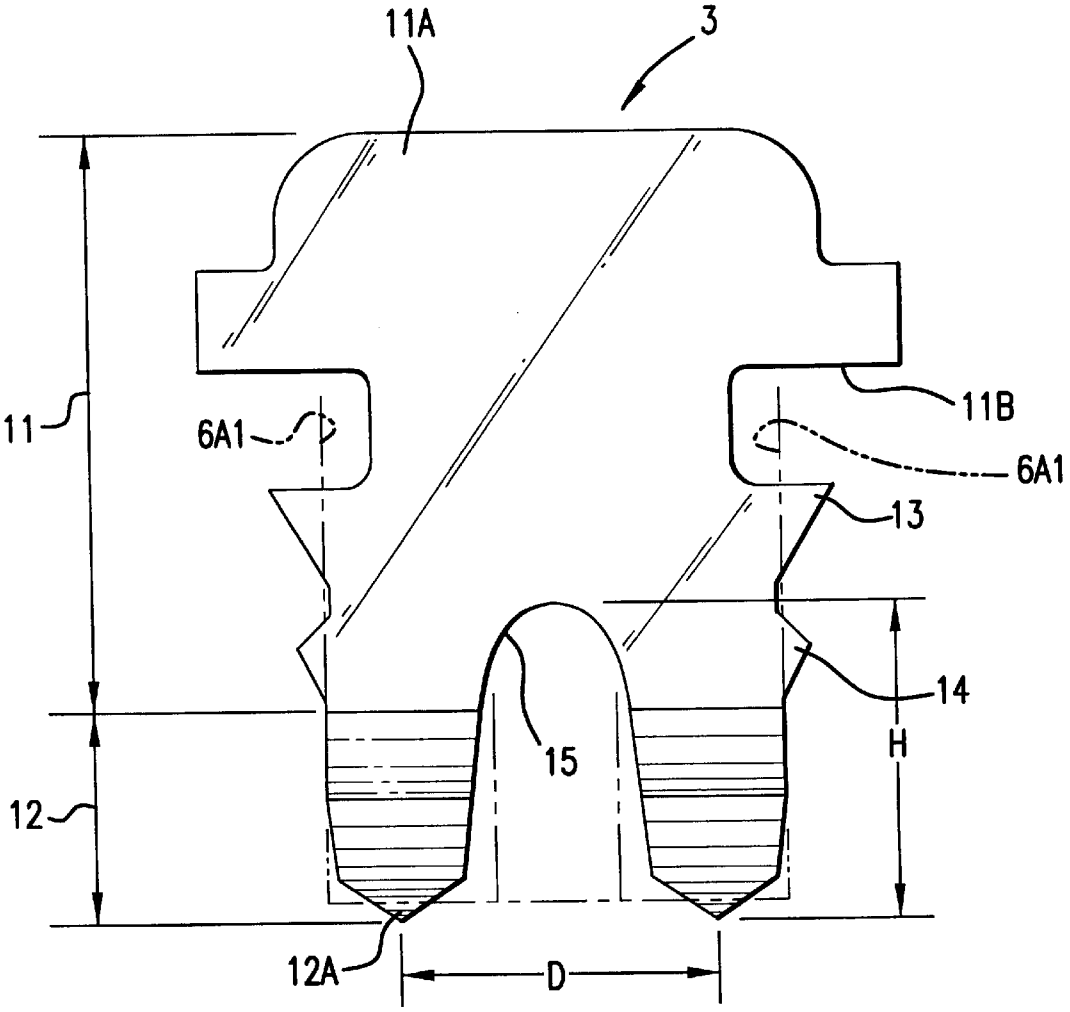
Figure 4:
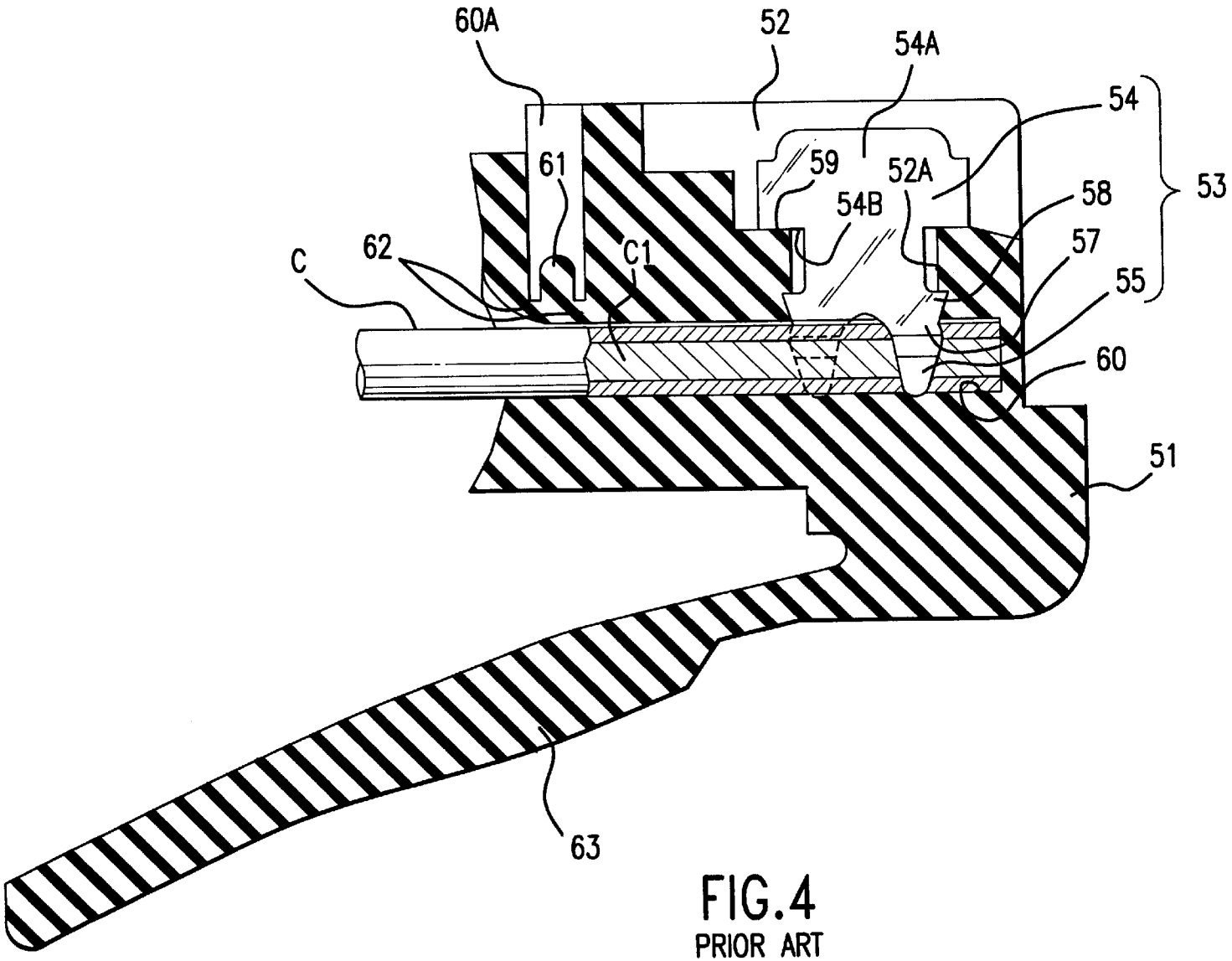
FIG. 4 PRIOR ART
FIG. 4 is a sectional view of a modular connector employing a conventional terminal.
Figure 5B:
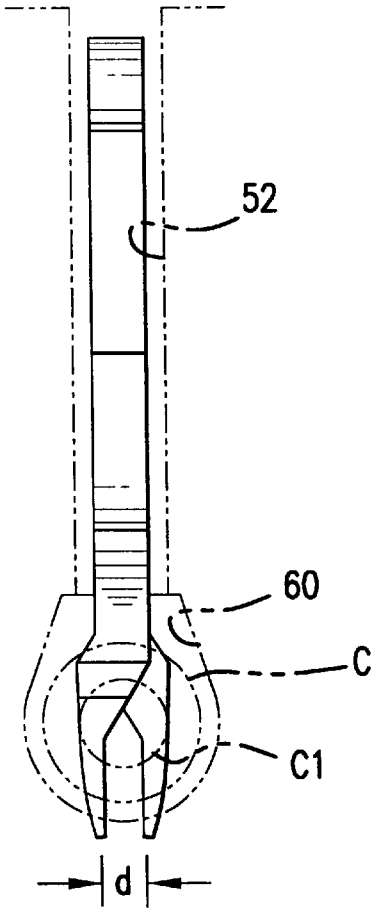
FIG.5B PRIOR ART
FIGS. 5(A) and (B) are front and sectional views of the conventional terminal.
Figure 5A:
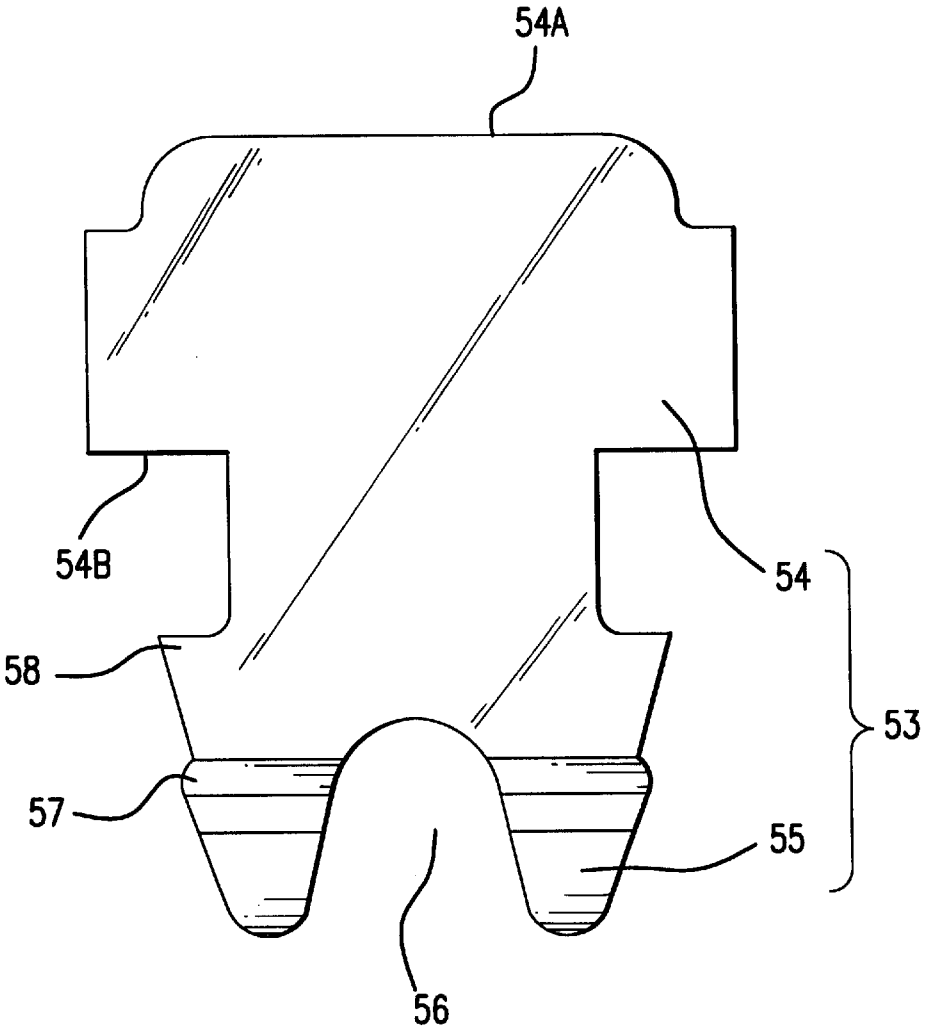
FIG.5A PRIOR ART

As shown in FIGS. 1, 2, and 3(A), the terminal 3 is made by punching a metal sheet. The terminal 3 has a flat terminal base 11 and a pair of pressure-connection blade members 12 which are displaced from each other in the direction of the terminal thickness. The terminal base 11 has a head portion 11A extending laterally to provide stop edges 11B. Also, it has permanent and temporary latch members 13 and 14 on opposite sides below the stop edges 11B.

The pressure-connection blade members 12 are separated by a U-shaped terminal recess 15 and have pointed ends 12A. The height (H) of the terminal recess 15 is greater than the distance (D) between the pointed ends 12A. The pressure-connection blade members 12 are displaced or offset in opposite directions such that the distance (d) between the pointed ends 12A in the direction of the terminal thickness is less than the diameter of the cable (C).

The dimensions of the terminal 3 and the pressure-insertion slots 6, the escape channels 6A, and the cable insertion holes 7 of the housing 1 before pressure-insertion are as follows.

The thickness of the pressure-insertion slot 6 is such that the terminal base 11 can be guided into the pressure-insertion slot 6.

The pressure-connection blade members 12 of the terminal 3 are received and guided by the escape channels 6A. The temporary and permanent latch members 14 and 13 interfere with the pressure-insertion slot 6 such that the degree of interference of the permanent latch members 13 is greater than that of the temporary latch members 14.

The amount of displacement between the pressure-connection blade members 12 is such that the distance (d) between the pointed ends 12A is less than the diameter of the cable (C) but substantially equal to the diameter of the core wire C1.

The connector according to the invention is assembled as follows.

(1) The respective terminals 3 are temporarily latched in the pressure-insertion slots 6. As shown by a two-dot broken line in FIG. 2, the temporary latch members 14 cut into the pressure-insertion slot 6 while the permanent latch members 13 are outside the pressure-insertion slot 6. In this manner, the remaining terminals 3 are temporarily latched in the other pressure-insertion slots 6 to provide a connector 1 having the terminals 3 provided in the housing 1.

(2) Then, the cables (C) are inserted into the connector 1. The pointed ends 12A of the pressure-connection sections 12 do not enter the cable insertion holes 7 so that the cables (C) reach the ends of the cable insertion holes 7.

(3) Then, a tool is applied to the head portions 11A of the terminals 3 until the stop edges 11B of the terminals 3 abut against the stop shoulders 5 of the housing. Like the temporary latch members 14, the permanent latch members 13 cut into the pressure-insertion slots 6. Since the permanent and temporary latch members 13 and 14 lie in the same plane, the permanent latch members further cut the traces made by the temporary latch members 13. Consequently, the amount of cut made by the permanent latch members 13 is so small that no large force is required to apply to the housing 2 upon pressure-insertion. Thus, no extensive damage is made to the pressure-insertion slots 6, and the terminals 3 are secured firmly.

(4) At the same time as the step (3), the pointed ends 12A of the pressure-connection blade members 12 penetrate through the sheaths of the cables (C) into the core wires (C1). Usually, the pointed ends 12A reach the bottom of the cable insertion holes 7.

(5) The diameter of the cable (C) is not always constant. When the cable is somewhat thick, the pressure-connection blade members 12 are more flexed in the direction of terminal thickness. The terminal recess 15 reaches the terminal base 11 and sufficiently deep to provide such flexibility.

(6) Thus, the terminals 3 are pressure-connected to the cables (C). Then, a tool T is inserted into the rear recess 8 of the housing to depress the plastic member 8B and thin-wall portions 8A so that the thin-wall portions 8A and the plastic members 8B enter the cable insertion holes 7 to crush the cables (C). Thus, the cables (C) are held in place.

(7) The connector 1 is now ready to be plugged or connected to a mating connector. In the plug-in process, the lock surface 9A of the lock arm 9 receives a pressure to flex upwardly the lock arm 9 before it is locked to the mating connector. To remove it from the mating connector, the lock arm is flexed again upwardly.

Since the permanent and temporary latch members lie in the same plane, the permanent latch members further cut the traces already made by the temporary latch members so that the amount of cut by the permanent latch members is so small that impacts on the housing are also small. Consequently, damage to the housing walls is so small that the terminals are secured with predetermined forces without wall damage. In addition, the terminal recess between the pressure-connection blade members extends up to the terminal base so that the pressure-connection blade members are so flexible in the thickness direction that they are able to receive somewhat thick cables.

What is claimed is:

1. A pressure-connection connector comprising:

a housing having a plurality of terminal slots opening at the upper face of said housing and a plurality of pressure-insertion slots extending downwardly from said terminal slots; and a plurality of terminals, each of said terminals comprises:

a terminal base provided in parallel to a plane including an axial direction of a cable;

a pair of pressure-connection blade members extending downwardly from said terminal base to form a terminal recess between them and displaced in opposite directions in a direction of terminal thickness;

at least one pair of permanent latch members provided on opposite side walls of said terminal base for engagement with side walls of said pressure-insertion slot; and at least one pair of temporary latch members provided on said opposite side walls below said permanent latch members for engagement with said side walls of said pressure-insertion slot, wherein each of said pressure-insertion slots being provided with a pair of escape channels extending vertically in opposite face of said each of said pressure-insertion slots so that said pressure-connection blade members of said terminal are received and guided by said escape channels.

2. A pressure-connection terminal according to claim 1, wherein said terminal recess extends to said terminal base.

3. A pressure-connection terminal according to claim 2, wherein said terminal recess extends to a point between said permanent and temporary latch members.

4. A pressure-connection terminal according to claim 1, wherein said blade members each have a pointed end, a distance between said pointed ends is less than an extension of said terminal recess.

5. A pressure-connection terminal according to claim 2, wherein said blade members each have a pointed end, a distance between said pointed ends is less than an extension of said terminal recess.

* * * * *